US008074990B2

(12) United States Patent
Kennedy et al.

(10) Patent No.: US 8,074,990 B2
(45) Date of Patent: Dec. 13, 2011

(54) HALLOWEEN AFTERNOON AT DRACULA 3-D CASTLE BOARD GAME

(76) Inventors: Marshall Kennedy, Sooke (CA); Heather Andrea Kennedy, Sooke (CA); Stephen Kennedy, Sooke (CA); Chris Kennedy, Sooke (CA)

( * ) Notice: Subject to any disclaimer, the term of this patent is extended or adjusted under 35 U.S.C. 154(b) by 0 days.

(21) Appl. No.: 12/959,357

(22) Filed: Dec. 2, 2010

(65) Prior Publication Data

US 2011/0133404 A1 Jun. 9, 2011

Related U.S. Application Data

(60) Provisional application No. 61/266,230, filed on Dec. 3, 2009.

(51) Int. Cl.
*A63F 3/00* (2006.01)

(52) U.S. Cl. ..... 273/241; 273/237; 273/287

(58) Field of Classification Search ..... 273/237, 273/241, 287
See application file for complete search history.

(56) References Cited

U.S. PATENT DOCUMENTS

| | | | | |
|---|---|---|---|---|
| 3,865,379 | A * | 2/1975 | Breslow | 273/237 |
| 4,339,135 | A | 7/1982 | Breslow et al. | |
| 4,391,447 | A | 7/1983 | Dudley | |
| 4,541,633 | A | 9/1985 | Newbill | |
| 4,772,027 | A * | 9/1988 | Martel et al. | 273/237 |
| 5,462,281 | A | 10/1995 | Gaito et al. | |
| 5,662,328 | A * | 9/1997 | Pecoy | 273/248 |
| 6,446,968 | B1 * | 9/2002 | Koch | 273/243 |
| 6,942,217 | B2 | 9/2005 | Cipullo | |
| 2004/0119230 | A1 | 6/2004 | Cipullo | |
| 2007/0284816 | A1 | 12/2007 | Drouhard | |

FOREIGN PATENT DOCUMENTS

| | | |
|---|---|---|
| GB | 2271724 A | 4/1994 |
| GB | 2415145 A | 12/2005 |
| WO | WO2005079452 | 9/2005 |

* cited by examiner

*Primary Examiner* — Vishu Mendiratta
(74) *Attorney, Agent, or Firm* — Thien Tran, Esq.; Access Patent Group, LLC

(57) ABSTRACT

A Halloween Afternoon at Dracula's Castle board game which comprises a game board having a first outer pathway level, a second middle pathway level and a third inner pathway level. A plurality of playing pieces is for use by players, wherein the playing pieces are positionable on the spaces. A plurality of player residences, trespass tokens for use by the players. A chance determining mechanism is for indicating a number of the spaces to be traversed by each playing piece. A plurality of play money, spookology cards, lucky/unlucky cards, Possession Cards, item cards are provided to the players. In addition, a plurality of player sound pieces is provided with light and a silhouette to replicate a spooky player and Halloween theme sounds. A three dimensional plastic pentagon shape castle was built on the game board. The 3-D castle has light and a silhouette to replicate Halloween theme sounds and songs.

20 Claims, 10 Drawing Sheets

HALLOWEEN AFTERNOON AT DRACULA 3-D CASTLE BOARD GAME

CROSS-REFERENCE TO RELATED APPLICATION

This application claims the benefit of Provisional Patent Application No. 61/266,230, filed on Dec. 3, 2009, in the United States Patent & Trademark Office, the disclosure of which is incorporated herein by reference.

BACKGROUND OF THE INVENTION

1. Field of the Invention

The present invention relates to a board game, and more particularly, a Halloween afternoon at Dracula's Castle board game.

The Halloween season is often over-shadowed by the impending Thanksgiving and Christmas holidays, which are more widely celebrated. For people who love Halloween, the season can be a bit anticlimactic. For example, there are very few, if any, Halloween-themed board games currently on the market; however, there are many Christmas-themed games currently being sold. Therefore, families and friends may not have a wide variety of activities to feature at Halloween parties and get-togethers. An effective solution is necessary.

The Halloween Afternoon at Dracula's Castle board game is designed for ages thirteen and up. This unique game combines Halloween trivia and strategic playing, creating a fun and challenging activity for friends and families. Perfect for parties and get-togethers, this game can bring the spirit of the Halloween season into any home.

2. Description of the Prior Art

Numerous innovations for themed board games have been provided in the prior art that will be described. Even though these innovations may be suitable for the specific individual purposes to which they address, however, they differ from the present invention.

A FIRST EXAMPLE, U.S. Pat. No. 4,339,135, Issued on Jul. 13, 1982, to Breslou et al. teaches an electronic computer game and method includes a matrix of 25 LED's (light emitting diodes) and two sets of push button switches positioned on opposite sides of the matrix. Each set of push buttons comprises a group of five push buttons corresponding to the five rows of the matrix and a group of five push buttons corresponding to the five columns of the matrix. Each set of push buttons is arranged so that the ten fingers of a player may be placed on the push buttons and any one of the LED's in the matrix may be rapidly selected by either player by simultaneous actuation of one push button in each of his groups. A game selector switch may be moved to select one of a number of games of action, reaction or strategy each of which is controlled by a microprocessor which stores selection of LED's by each player, sets up random patterns on the matrix which are randomly altered, keeps track of each player's score and provides audible and visual signals informing the players of the progress of the game, etc.

A SECOND EXAMPLE, U.S. Pat. No. 4,391,447, Issued on Jul. 5, 1983, to Dudley teaches an electronic game for positional games such as chess comprises a playing board and a plurality of playing pieces, each piece being movable between playing positions on the playing board in accordance with a predetermined pattern which is influenced by the locations of other playing pieces. Each playing piece is encoded in accordance with its identity, and each playing position automatically responds to the encoding when it is occupied by a playing piece. An electrical circuit associated with the playing position causes other positions to which the playing piece is capable of moving to be illuminated with an appropriate color. Each playing piece includes light sources which are illuminated when the playing piece is in jeopardy of being captured by an opposing playing piece or is covered by a friendly playing piece. The intensity of attack and the depth of cover may also be indicated. The playing pieces are automatically oriented in a predetermined manner when they are placed on a playing position in order to establish electrical contact between electrical terminals on the base of the playing piece and electrical terminals on the playing position.

A THIRD EXAMPLE, U.S. Pat. No. 4,541,633, Issued on Sep. 17, 1985, to Newbill teaches an electronic strategy game featuring playing fields comprising two chess-like boards each of which may contain 64 squares and be separated from each other by a partition of suitable size to conceal the moves made by each player and two sets of chessmen positioned on each board. Each square has a sensor embedded in its base arranged to transmit to an electronic processing unit the location of all chessmen on the game boards. The electronic processing unit determines the game status, controls announcements to the players, and includes logic whereby the position of all chessmen are maintained in a memory and moves are regulated in accordance with predetermined rules such as the rules of chess. Requests for additional status information and the selection of optional game features are transmitted to the electronic processing unit via two control panels located one on each game board. The electronic game includes features not normally available to players utilizing a human referee. These features include "timed games" where each player has a limited amount of time to execute his next move and a replay feature where the previous game can be automatically replayed to allow the players to determine whether their analysis of the battlefield conditions were correct.

A FOURTH EXAMPLE, U.S. Pat. No. 4,772,027, Issued on Sep. 20, 1988, to Martel et al. teaches a board game which comprises a board on which objects can be placed by participating players. An electrically powered sensor/indicator device is mounted to the board, the device incorporating electronic logic circuitry and indicator elements connected to the logic circuitry. A plurality of triggering devices are electrically connected to the logic circuitry. The triggering devices are operable by players of the game and the logic circuitry is actuatable by the triggering devices to electrically operate the indicator elements to signify a player who has first operated one of the triggering devices.

A FIFTH EXAMPLE, U.S. Pat. No. 5,462,281, Issued on Oct. 31, 1995, to Gaito et al. teaches a board game defines a plurality of playing positions in the form of a gridwork including a plurality of discrete, electrically isolated, metal frames, each frame enclosing one of the playing positions and supporting a translucent coextensive window. Playing pieces, some being of different types, are movable between playing positions in accordance with a predetermined pattern dependent upon their type and influenced by the locations of other playing pieces. A regulating system selectively alters a sensible characteristic at each of the playing positions to thereby alter an attribute of a playing piece which lands on a certain one of the playing positions. This is done by successively illuminating each of the playing positions by means of one or more colored electric lamps or by providing no illumination at all. The regulating system has a first operating mode for manually altering the illumination at each of the playing positions and a second operating mode for randomly altering the illumination at each of the playing positions. The regulating system also includes touch circuitry responsive to sequential touches by a user to operate, in sequence, a first lamp alone at a playing position, then a second lamp alone at that playing position, then no lamp at that playing position. The regulating system can also randomly operate the lamps at the playing positions, and is also capable of adjusting the time interval between random operations and the random number generating means and the number of the playing positions subject to such random operations.

A SIXTH EXAMPLE, U.S. Pat. No. 5,662,328, issued on Sep. 2, 1997, to Pecoy teaches a board game includes a game board which includes a predetermined number of start/stop positions, a predetermined number of trick or treat positions, and a single endless path which includes a start/stop path portion adjacent to the start/stop positions and a trick-or-treat path portion adjacent to the trick or treat positions. The endless path defines an interior board region which includes a first capture region, a second capture region, a first safe region, and a second safe region. The endless path includes a sequential array of segments which include capture-free segments interspersed with capture-susceptible segments. A predetermined number of groups of Halloween treat cards are provided which corresponds to the predetermined number of trick or treat positions. A predetermined number of treat-receiving player tokens are provided. A first player-capturing token is associated with the first capture region, and a second player-capturing token is associated with the second capture region. During their respective turns, the first and second capture tokens are enabled to capture a specific treat-receiving player token when the specific treat-receiving player token lands on a capture-susceptible segment of the endless path. A pair of dice is used for determining a number of segments along the endless path that a specific treat-receiving player token advances during its turn.

A SEVENTH EXAMPLE, U.S. Pat. No. 6,446,968, issued on Sep. 10, 2002, to Koch teaches a themed board game, that is family oriented and recreates the fun and wonder of Halloween, preferably for 3 to 8 players (ages preferably 8 and older), and takes about one hour to play. A game board has printed thereon a thematic scene, a preferred example of which being a Haunted House. Twin sets of cards each include three category groups: a place category (depicted as locations of the Haunted House), an entity category (Halloween related persons or things, as for example a werewolf, a witch, a ghost, etc.), and an event category (Halloween related occurrences, as for example a scream, a laugh, a howl, an odor, etc.). A randomizing instrument is provided, preferably in the form of a single die which preferably may uniquely include a Halloween indicia in place of the six dots face (as for example a cat or a jack-o-lantern). Three cards, one from each category are secretly selected, the indicia of which form a Haunting Mystery. Players try to solve the Haunting Mystery by deducing which of the cards in play have no matching duplicate. This objective is achieved in the course of play by a careful process of elimination of possibilities by each player using his/her "Tracking Chart".

AN EIGHTH EXAMPLE, U.S. Patent Office Publication No. 2004/0119230, Published on Jun. 24, 2004, to Cipullo teaches a new game is provided that involves strategy and racing through the use of game units comprising a plurality of game pieces, wherein the game promotes teamwork and cooperation. This game is governed by at least one rule requiring that the plurality of game pieces of each game unit be within a predetermined number of spaces. Although this rule is a constraint on the movement of the game pieces, this game preferably gives players the opportunity to use this rule as a shield or sword. The game can be played in solitude, but is preferably played with multiple persons. The game ends when a game unit returns to a home position, but the player with the greatest number of points, preferably treats, is the winner.

A NINTH EXAMPLE, U.S. Pat. No. 6,942,217, issued on Sep. 13, 2005, to Cipullo teaches a new game that involves strategy and racing through the use of game units comprising a plurality of game pieces, wherein the game promotes teamwork and cooperation. This game is governed by at least one rule requiring that the plurality of game pieces of each game unit be within a predetermined number of spaces. Although this rule is a constraint on the movement of the game pieces, this game preferably gives players the opportunity to use this rule as a shield or sword. The game can be played in solitude, but is preferably played with multiple persons. The game ends when a game unit returns to a home position, but the player with the greatest number of points, preferably treats, is the winner.

A TENTH EXAMPLE, U.S. Pat. No. 7,219,894, issued on May 22, 2007, to Stewart et al. teaches board games which may include a game board, player movers, and indicia-bearing tokens and player-wearable costume components including one or more mounting sites to which the tokens may be removably attached. Some embodiments may further include game pieces having indicia indicating one or more of the tokens. Thus, some methods of game play may involve each player attempting to collect a predetermined set of tokens by determining if various game pieces indicate any of the tokens in the set. Other methods may involve concealing the indicia on one or more game pieces, and allowing players to attempt to guess the concealed indicia by the process of elimination.

AN ELEVENTH EXAMPLE, U.S. Patent Office Publication No. 2007/0284816, Published on Dec. 13, 2007, to Drouhard teaches a method of playing a board game of pursuit for at least one of a first and a second player; where the board includes a pathway made up from a number of discrete squares and includes at least a starting position. The method of play includes the steps of the first and second players taking alternating turns to determine the number of squares to move along the pathway; deciding whether to move in one of a first and a second direction along the pathway; and positioning a marker at the square so determined. The game ends when the second player is able to position their marker on the same square as the first player. The board may also be provided with a finishing position remote from the starting position. In this instance, the game ends when the first player reaches the finishing position prior to the second player being able to position their marker on the same square as the first player. The game may include hazards along the pathway that require the players to pay a penalty before resuming play. The game may further include objects positioned on squares along the pathway that need to be collected by one or both of the players during play.

It is apparent now that numerous innovations for themed board games have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a Halloween Afternoon at Dracula's castle board game that avoids the disadvantages of the prior art.

ANOTHER OBJECT of the present invention is to provide a Halloween Afternoon at Dracula's castle board game that is simple and inexpensive to manufacture.

STILL ANOTHER OBJECT of the present invention is to provide a Halloween Afternoon at Dracula's castle board game that is simple to use.

BRIEFLY STATED, STILL YET ANOTHER OBJECT of the present invention is to provide a Halloween Afternoon at Dracula's castle board game which comprises a game board having a first outer pathway level, a second middle pathway level and a third inner pathway level. The first outer pathway level is in the form of a pentagon consisting of a plurality of contiguous delineated spaces. The second middle pathway level is in the form of a pentacle five pointed star consisting of a plurality of contiguous delineated spaces. The third inner pathway level is in the form of a diamond consisting of a plurality of contiguous delineated spaces and a Finish location. A plurality of playing pieces is for use by players, wherein the playing pieces are positionable on the spaces. A plurality of player residences is for use by the players. A plurality of trespass tokens are for use by the players. A chance determining mechanism is for indicating a number of the spaces to be traversed by each playing piece. A plurality of play money of different denominations is for distribution in part thereof to each player. A plurality of spookology cards are provided in a skeleton shaped case/holder. Each spookology card has a Halloween question and answer thereon, so that when one playing piece lands on a space indicating a pick of one spookology card the player of the playing piece will answer the Halloween question and react in accordance with the risk/reward instructions. A plurality of lucky/unlucky (Superstition) cards is provided in a Pumpkin shaped case/holder. Each lucky/unlucky card has lucky/unlucky situations thereon, so that when one playing piece lands on the space indicating a pick of one lucky/unlucky card, the player of the playing piece will follow the instructions in accordance with the corresponding risk/reward instructions on card. A plurality of possession cards to denote ownership of a location. A plurality of item cards is provided. Each of the item cards can be bought by each player with the play money, received upon start of game, or through the game cards. A plurality of player sound pieces is provided. Each has a light and a silhouette to replicate a spooky player and Halloween sounds. A Halloween Afternoon press to activate button can be incorporated and assembled within the board; when pressed will emit Halloween sounds and activate lights. A bank tray is provided to store the remainder of the play money not distributed to the players, the item cards, and possession cards therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The FIGS. 1-15 of the drawings are briefly described as follows.

REFERENCE NUMERALS UTILIZED IN THE DRAWING

Figure 1:
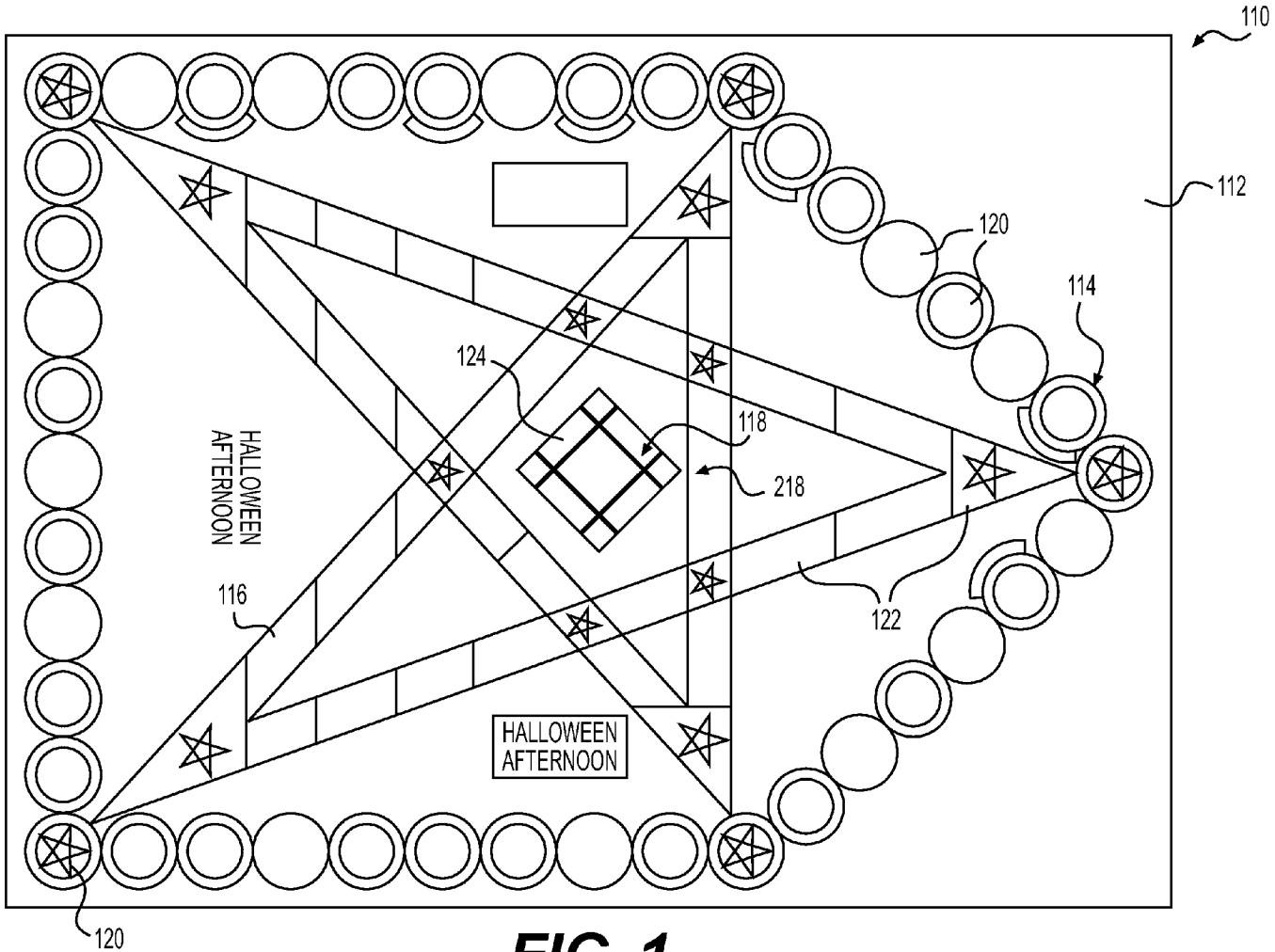
FIG. 1 is a plan view of the game board of the present invention.

110 Halloween afternoon at Dracula's castle board game
112 game board of board game 110
114 first outer pathway level on game board 112
116 second middle pathway level on game board 112
118 third inner pathway level on game board 112
120 space in pathway level 114
122 space in pathway level 116
124 space in pathway level 118
126 playing piece of board game 110
128 player residence of board game 110
130 trespass token of board game 110
130A Skeleton Card holder for Spookology Cards 136
130B Pumpkin holder for Lucky/unlucky Superstition cards 138
132 chance determining mechanism of board game 110
134 play money of board game 110
136 spookology card of board game 110
138 lucky/unlucky card of board game 110
140 item card of board game 110
142 player sound piece of board game 110
144 bank tray of board game 110
145 Possession cards of Board game 110
146 Dracula for playing piece 126
148 female vampire for playing piece 126
150 male vampire for playing piece 126
152 U-man for playing piece 126
154 U-woman for playing piece 126
156 ghost for playing piece 126
158 witch for playing piece 126
160 Frankenstein monster for playing piece 126
162 skeleton for playing piece 126
164 mummy for playing piece 126
166 headless horseman for playing piece 126
170 zombie for playing piece 126
172 haunted house for player residence 128
174 brewery for player residence 128
176 pub for player residence 128
178 headstone for player residence 128
180 pyramid for player residence 128
182 haunted tree house for player residence 128
184 doghouse for player residence 128
186 crypt for player residence 128
188 ghost post on trespass token 130
190 hat on trespass token 130
192 hand on trespass token 130
194 skull on trespass token 130
196 coffin on trespass token 130
198 pumpkin on trespass token 130
200 half moon on trespass token 130
202 brain on trespass token 130
204 dice for chance determining mechanism 132

206 base member for game board 112
208 castle for game board 112
210 roof of castle 208
212 outer wall of castle 208
214 tower of castle 208
216 five pointed star space on tower 214
218 Transformation room 116/112
220 Dracula's Domain 3rd level/tower for board game 112

DETAILED DESCRIPTION OF THE PREFERRED EMBODIMENT

Referring now to the figures, in which like numerals indicate like parts, FIGS. 1 through 15 shows various components of the present invention, that is a Halloween Afternoon at Dracula's 3-D castle board game 110 which comprises a game board 112 having a first outer pathway level 114, a second middle pathway level 116 and a third inner pathway level 118. The first outer pathway level 114 is in the form of a pentagon consisting of a plurality of contiguous delineated spaces 120. The second middle pathway level 116 is in the form of a pentacle five pointed star consisting of a plurality of contiguous delineated spaces 122. The third inner pathway level 118 is in the form of a diamond consisting of a plurality of contiguous delineated spaces and inner Finish location 124. A plurality of playing pieces 126 are for use by players, wherein the playing pieces 126 are positionable on the spaces 120, 122, 124.

A plurality of player residences 128 are for use by the players. A plurality of trespass tokens 130 are for use by the players. A chance determining mechanism 132 is for indicating a number of the spaces 120, 122, 124 to be traversed by each playing piece 126. A plurality of play money 134 of different denominations is for distribution of part thereof to each player. A plurality of Spookology cards 136 is provided. Each Spookology card 136 has a Halloween question, answer, and risk/reward instruction thereon, so that when one playing piece 126 lands on a space 122, 124 indicating a pick of one Spookology card 136 the player of the playing piece 126 will answer the Halloween question and respond to instruction.

A plurality of lucky/unlucky Superstition cards 138 is provided. Each lucky/unlucky card 138 has a lucky/unlucky situation thereon, so that when one playing piece 126 lands on the space 120, 122, 124 indicating a pick of one lucky/unlucky card 138, the player of the playing piece 126 will follow the instructions. A plurality of Possession Cards 145 given to a player that obtains a location by correct roll of dice or in play of game.

Figure 2:
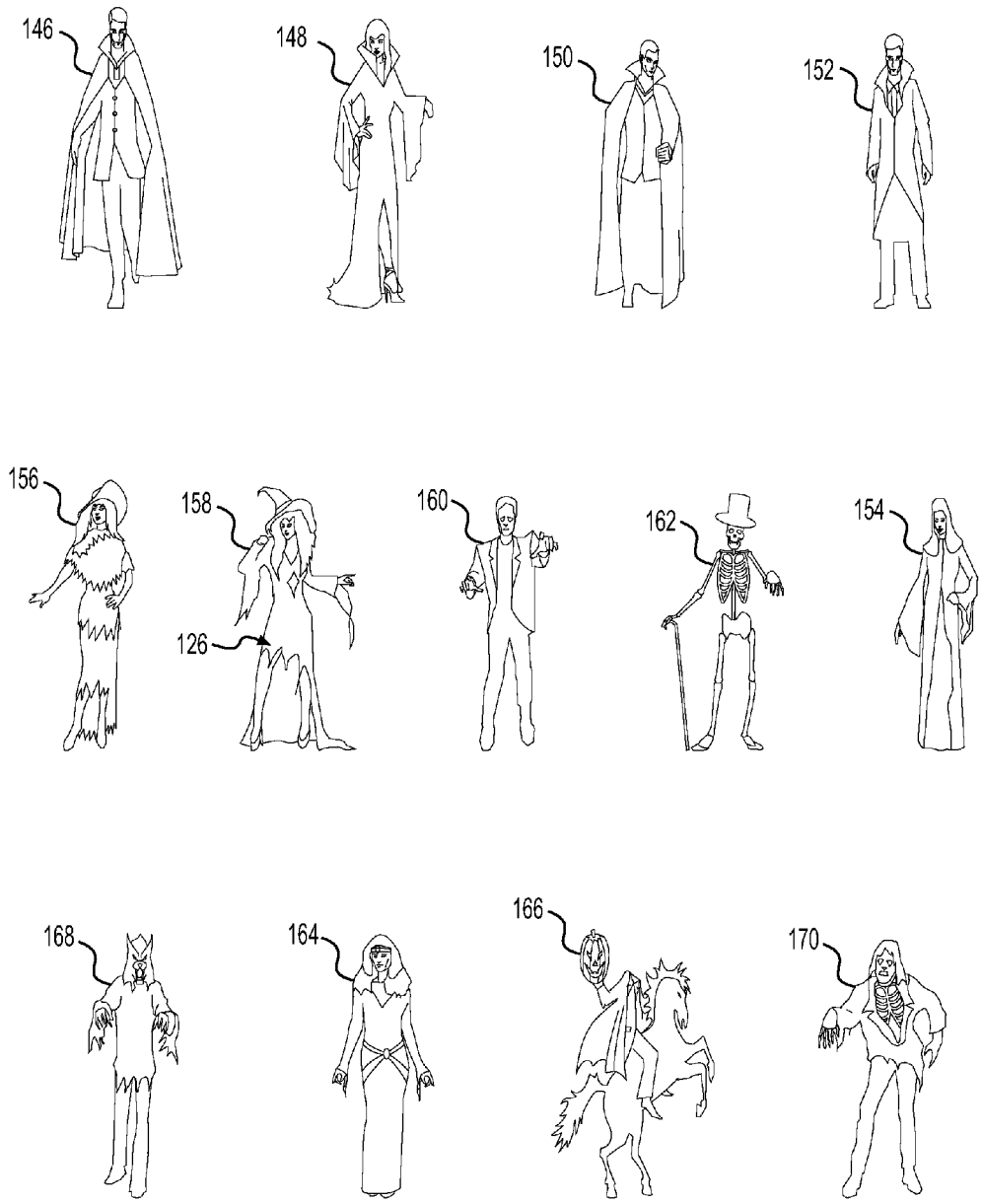
FIG. 2 is an elevational view of the playing pieces.

In FIG. 2: Each playing piece 126 comprises a figure of Dracula 146, female vampire 148, male vampire 150, U-Man 152, U-Woman 154, ghost 156, witch 158, Frankenstein monster 160, skeleton 162, mummy 164, headless horseman 166, werewolf 168 and zombie 170.

Figure 3:
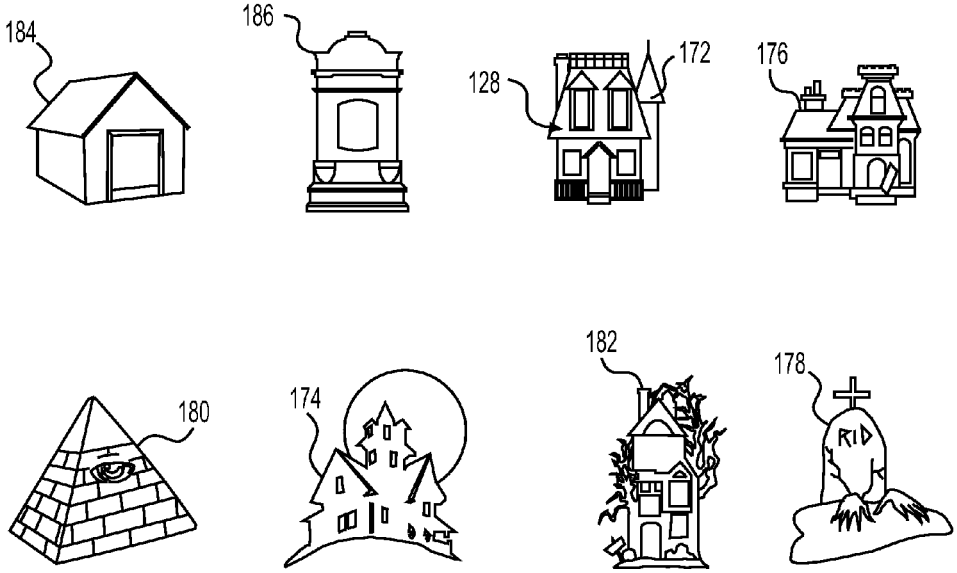
FIG. 3 is an elevational view of the player residences.

In FIG. 3: Each player residence 128 comprises a haunted house 172 for the ghost 156, a brewery 174 for the witch 158, a pub 176 for the Frankenstein monster 160, a headstone 178 for the skeleton 162, a pyramid 180 for the mummy 164, a haunted tree house 182 for the headless horsemen 166, a doghouse 184 for the werewolf 168 and a crypt 186 for the zombie 170.

Figure 4:
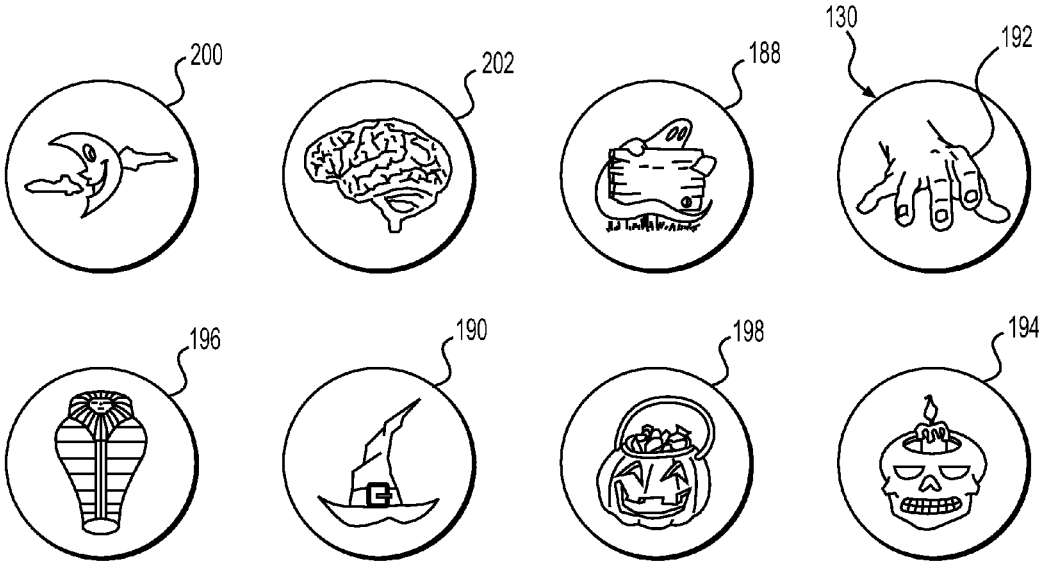
FIG. 4 is a plan view of the trespass tokens.
Figure 5:
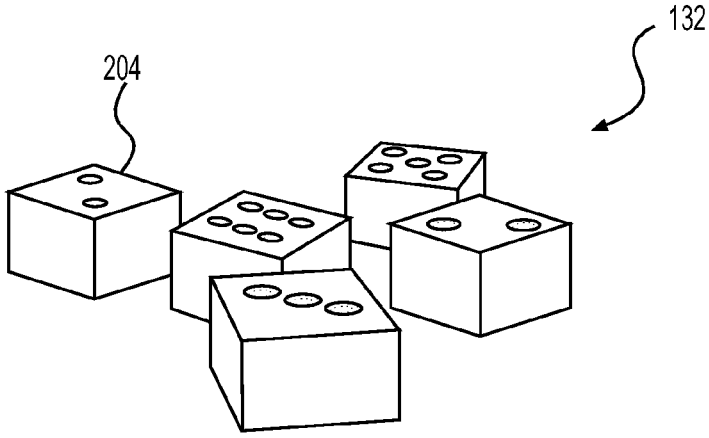
FIG. 5 is a perspective view of the five playing dice.
Figure 6:
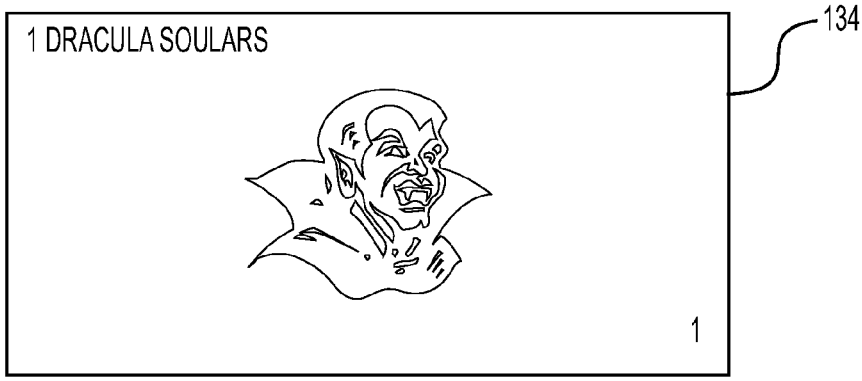
FIG. 6 is a plan view of one of the pieces of the play money.
Figure 7:
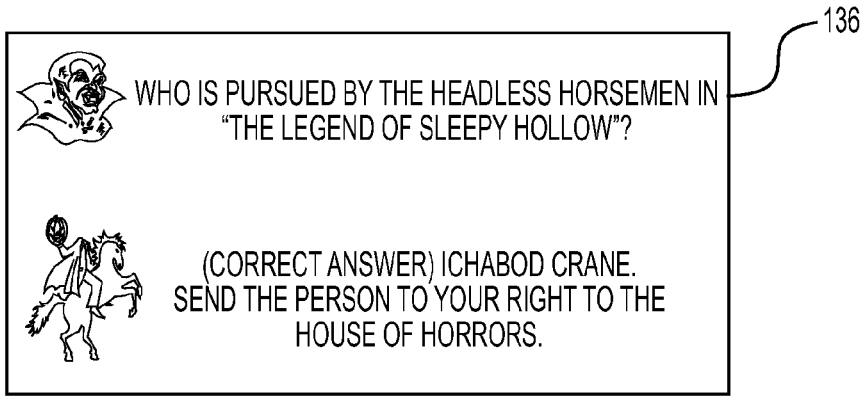
FIG. 7 is a plan view of one of the spookology cards.

In FIG. 4: Each trespass token 130 comprises a picture of a ghost and signpost 188 for the ghost 156, a hat 190 for the witch 158, a hand 192 for the Frankenstein monster 160, a skull 194 for the skeleton 162, a coffin 196 for the mummy 164, a pumpkin 198 for the headless horseman 166, a half moon 200 for the werewolf 168 and a brain 202 for the zombie 170. The chance determining mechanism 132 comprises five playing dice 204 (as shown in FIG. 5) that are each pumpkin colored with bones as counters. The denominations of the play money 134, 136 consist of 1, 5, 10, 20, 50 and 100 dracoola-soulars (as shown in FIGS. 6-7).

Figure 8:
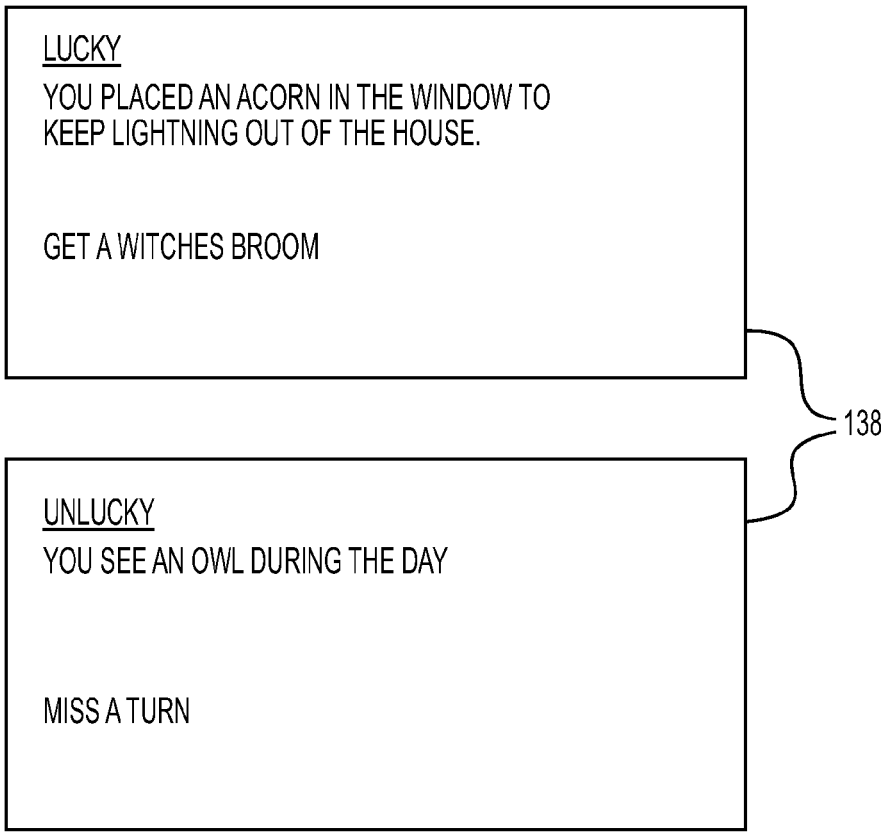
FIG. 8 is a plan view of two of the lucky/unlucky cards.

In FIG. 8: One of the lucky/unlucky cards 138 comprises the words "TRICK OR TREAT" generic to Halloween theme. Each item card 140 contains a holy cross, a heart, a holy bible, a ray of hope (sunshine), holy water, a garlic clove, a wooden stack, a vial of blood, a dagger, a voodoo amulet, a magic rope, an enchanted ladder, a broom, a skeleton key, a lantern, a list of magic spells, an invisibility spell, a silver bullet, a book of the living, a bag of salt, a cloak of skin, a lightening rod, and a horseman's head.

Figure 9:
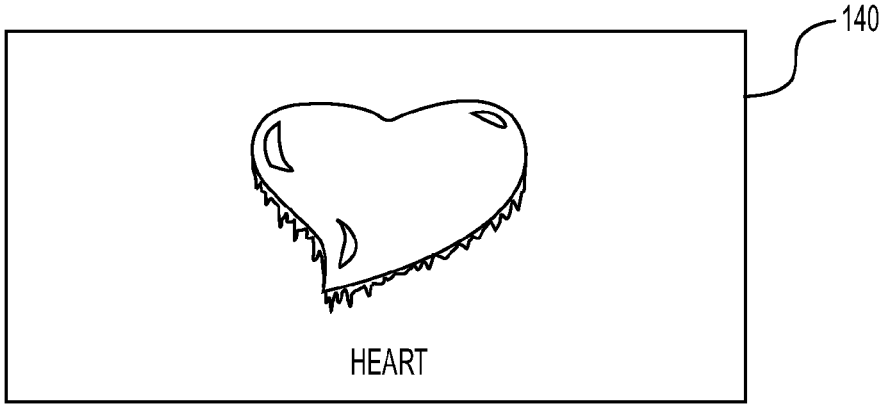
FIG. 9 is a plan view of one of the item cards.

In FIG. 9: A plurality of item cards 140 is provided. Each of the item cards 140 are distributed at start or can be bought by each player with the play money 134.

Figure 10:
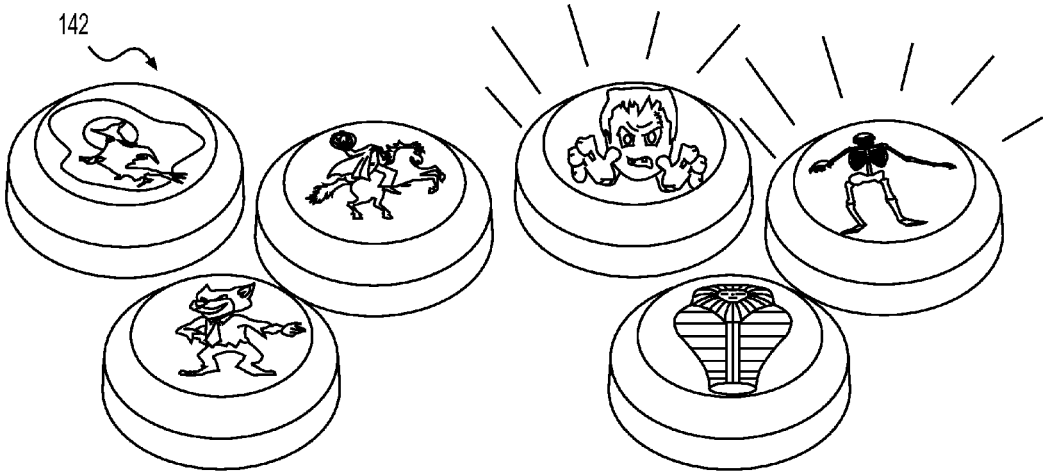
FIG. 10 is a perspective view of the player sound pieces.

In FIG. 10: a plurality of player sound pieces 142 is provided. Each has a light and a silhouette to replicate a spooky player and Halloween sounds and/or a press to activate sound mechanism can be incorporated into playing board 110.

Figure 11:
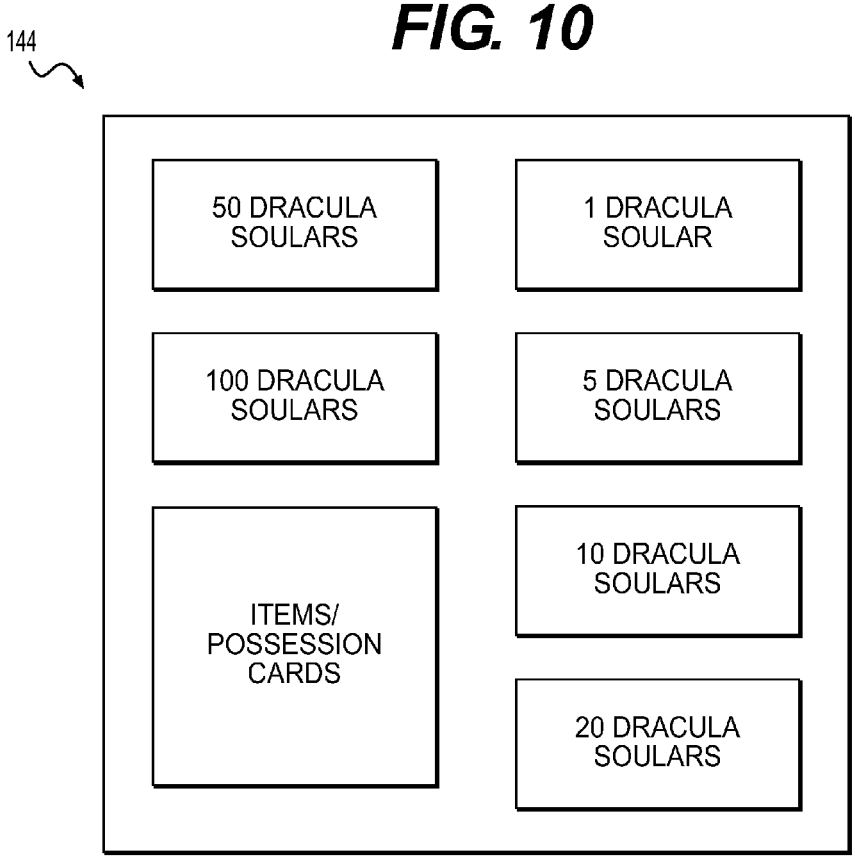
FIG. 11 is a top plan view of the bank tray.

In FIG. 11: a bank tray 144 is provided to store the remainder of the play money 134 not distributed to the players and the item cards 140 and Possession Cards 145 therein. Skeleton Card Case 130A is provided for Spookology Cards (FIG. 7). Pumpkin Card Case 130B is for Lucky/Unlucky Cards (FIG. 8).

Figure 12:
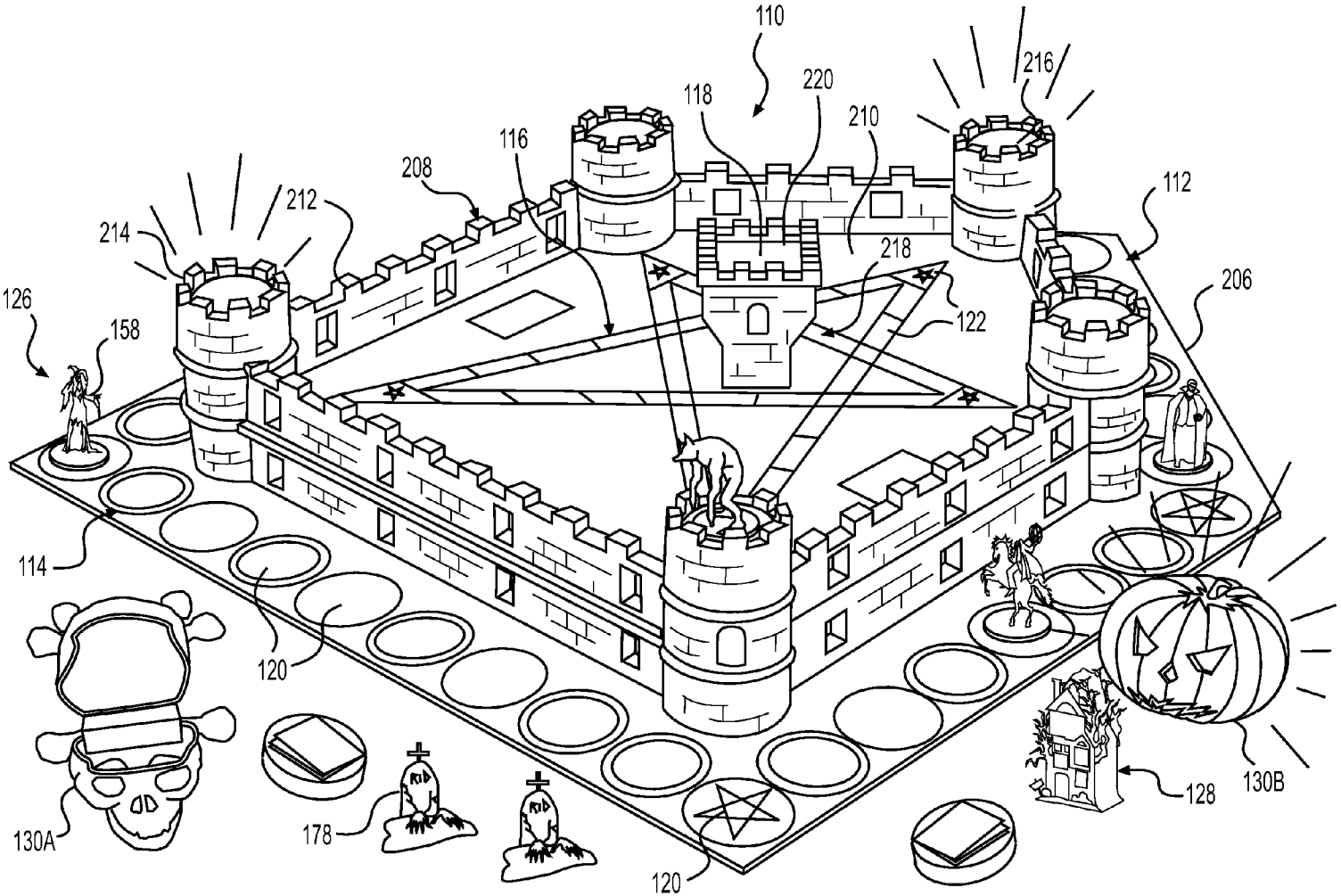
FIG. 12 is a perspective view showing the game board as a castle configuration, with some of the playing components.

As shown in FIG. 12, in the board game 110 game board 112 comprises a flat pentagon shaped base member 206 having the first outer pathway level 114 located about its perimeter, wherein each space 120 at a corner of the base member 206 has a five pointed star thereon. A three-dimensional pentagon shaped castle 208 is provided having a roof 210, an outer wall 212 and five towers 214. Each tower 214 is located at one corner of the outer wall 212 and has a five pointed star space (to indicate level change and answer of a spookology question) 216 thereon. The second middle inner pathway level 116 is located on the roof 210 of the castle 208. Each space 122 on one point of the pentacle five pointed star has a five pointed star thereon. The castle 208 is mounted onto the base member 206. A three-dimensional Dracula's Domain (3rd level) tower 220 is mounted on the second level 208 within 116, containing the third upper pathway level 118 located on top of Dracula's Domain 220. The 3rd level tower, Dracula's Domain and (Finish), is mounted onto and trough the roof of 210; centrally within pathway 116.

Figure 13:
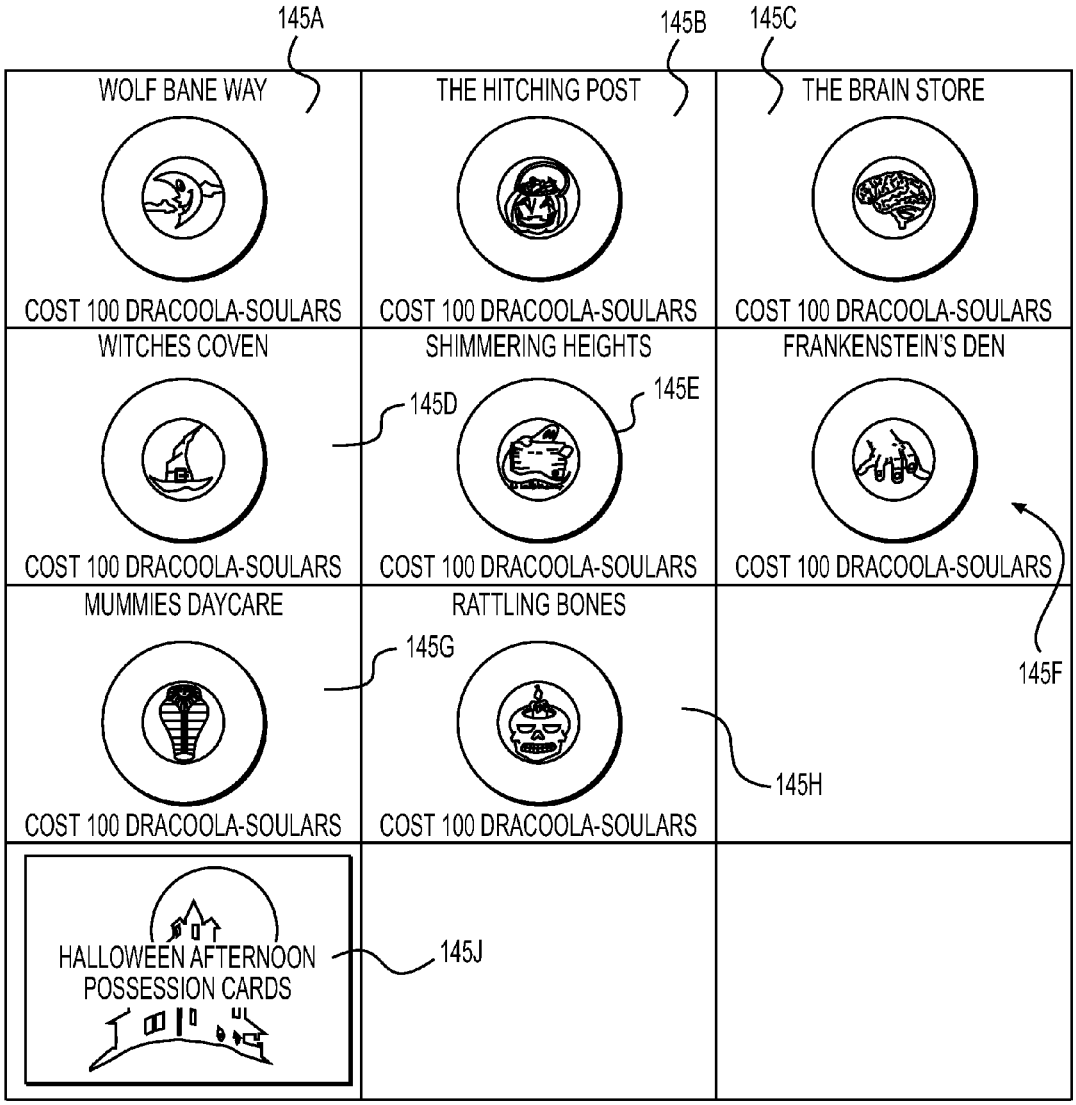
FIG. 13 is a plan view of one of the Possession Cards.

In FIG. 13: A plurality of Possession Cards 145 to indicate a player has taken possession of a playing area 114. A set of Halloween Afternoon Possession Cards 145, 8 of 40 are shown: Wolf Bane Way (cost 100 Dracoola-Soulars), the Hitching Post (cost 100 Dracula-Soulars/Dracool-soulars), the Brain Store (cost 100 Dracula-Soulars), Witches Cover (cost 100 Dracula-Soulars), Shimmering Heights (cost 100 Dracula-Soulars), Frankenstein's Den (cost 200 Dracula-Soulars), Mummies Daycare (cost 200 Dracula-Soulars), Rattling Bones (cost 100 Dracula-Soulars).

Figure 14:
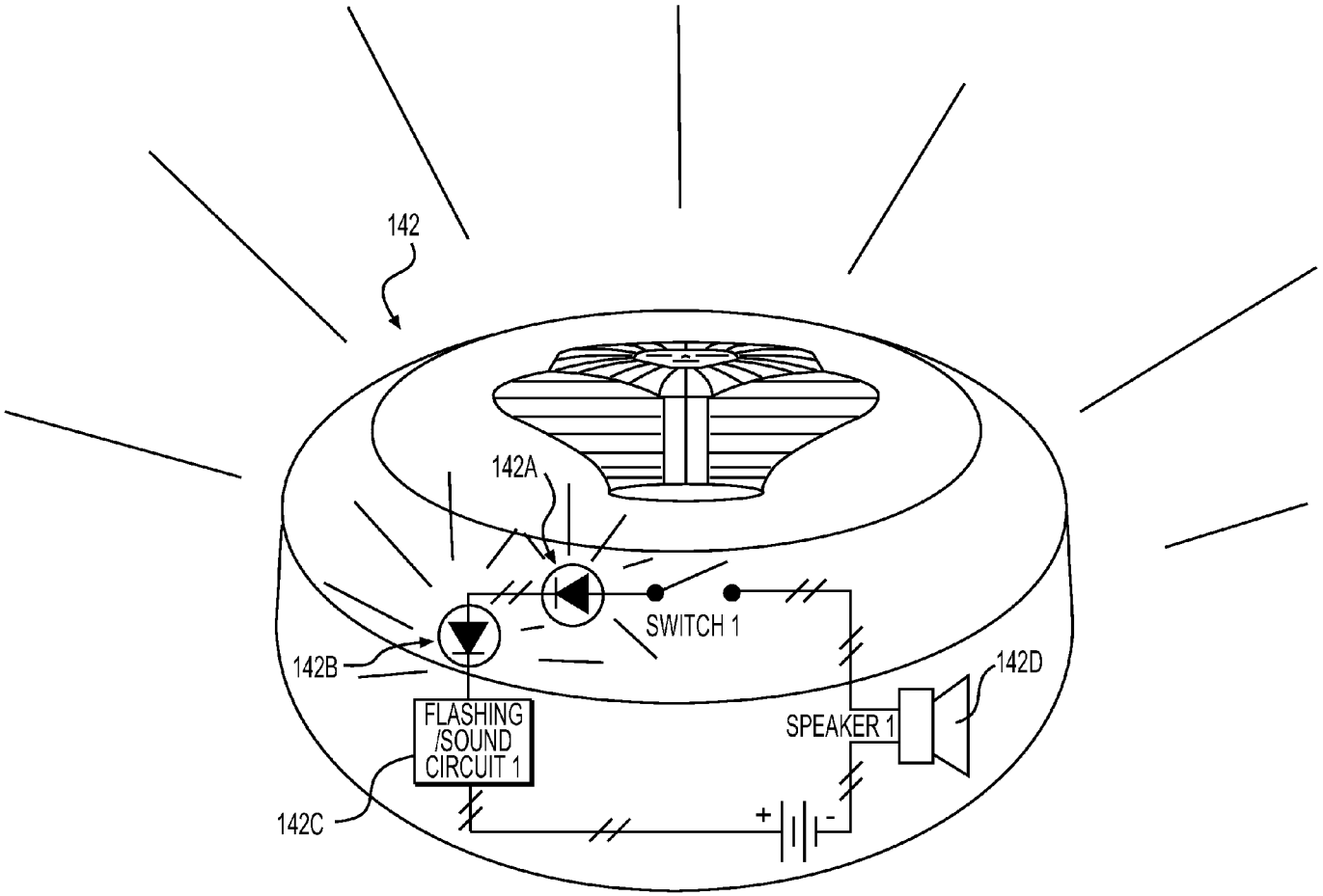
FIG. 14 is an electronic light flashing/sound circuitry for each player sound piece.

In FIG. 14: each player sound piece 142 can have a battery, a switch, LEDs 142A-142B, a flashing/sound circuit 142C and a spooky speaker (or spooky buzzer) 142D. The battery can be 1.5 Volts, 3 Volts, 4.5 Volts and 6 Volts. The flashing can be sequential, strobbing or chasing patterns in a timing sequence (via a timer) such as 1-15 flashes per second. The sound circuitry can have different Halloween theme sounds/songs.

Figure 15:
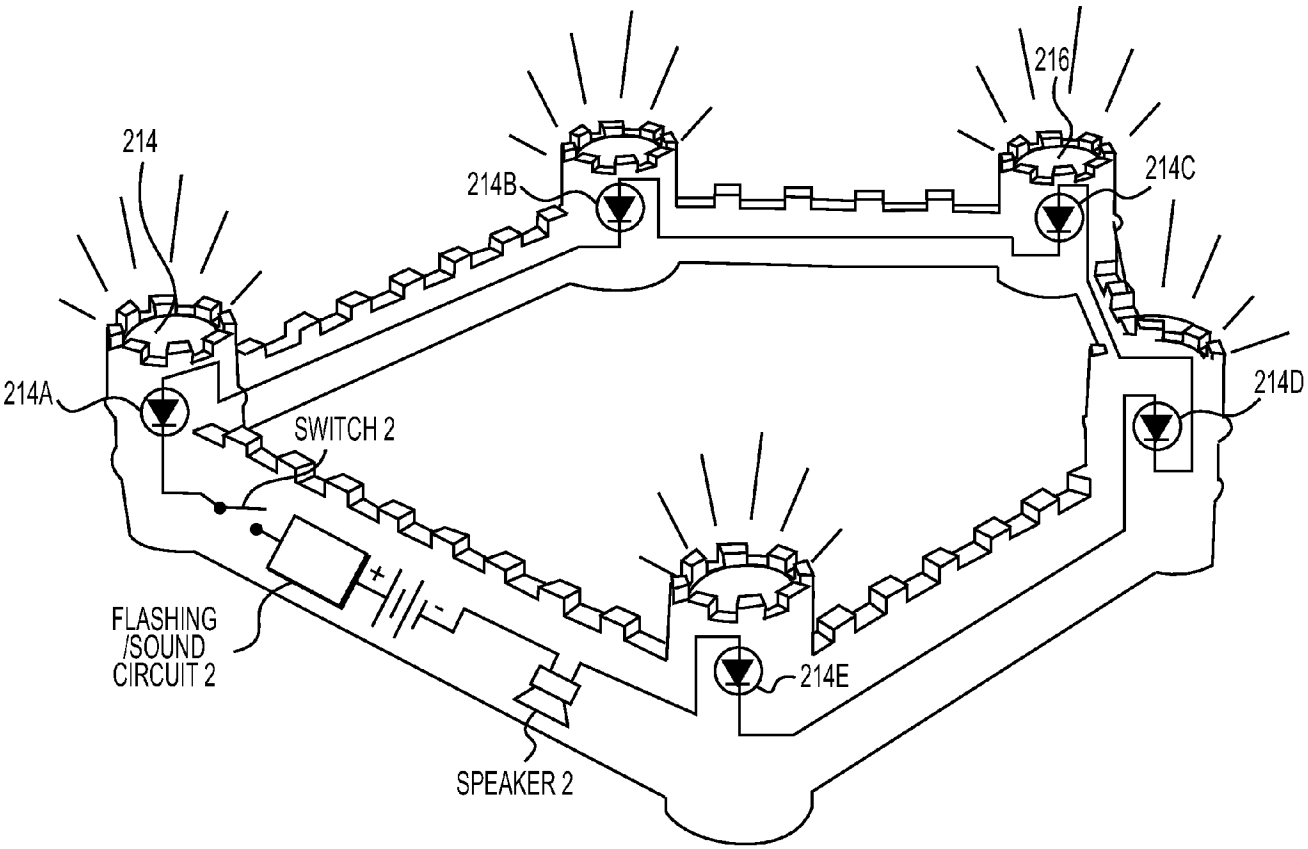
FIG. 15 is an electronic light flashing/sound circuitry for each tower of three dimension castle.

In FIG. 15: The three dimension 3-D castle includes a switch 2, a flashing/sound circuit 2, each light emitting diodes LEDs 214A-214E (e.g. miniature lights or lamps can also be used) in each tower 214 of castle 208 and spooky speaker (or spooky buzzer) 2. The battery can be 3 Volts, 6 Volts, 7.5 Volts, 9 Volts, 12 Volts and 15 Volts. The flashing/sound circuitry can be a combined circuitry or separated into a flashing circuitry and a sound circuitry. The flashing can be sequential, strobbing or chasing patterns in a timing sequence (via a time) with different rate 1-15 flashes per second. The sound can have Halloween theme sounds/songs. The three dimensional 3-D castle 208 is made of plastic. The light emitting diodes LEDs may illuminate in a variety of colors. The sound circuitry can be replaced with a CD/DVD disk with DVD player (not shown) with Halloween theme sounds/songs thereon.

Rules of the Game

Purpose of the game is to travel round the game board, collect items, possession cards, and dracool-soulars in order to transform in the transformation room becoming human. Then to move to third level via portal to fight Dracula (non-humans can't fight Dracula). If Spookology card (when challenging Dracula) is answered incorrectly, then that player on level three becomes a (lesser vampire) and returns to start of game. The Lesser Vampire when landing on a space occupied by another player in subsequent play retires that player from the game.

You collect items and dracula-soulars by answering questions correctly on the Lucky/Unlucky (Superstition Cards) and Spookology Cards. You can also collect Dracula-soulars by owning various locations or by Trick or Treating around the game board. Trespass tolls can be placed on the Graveyard, House of Horrors, and Room of Skulls by rolling a particular sequence of numbers to avoid paying toll or avoid being trapped on these spaces.

When player 126 reaches the Transformation Room 218 on 2nd level; if that player 126 has the required Item Cards, Possession Cards, and 3000 Dracula-soulars then that player can substitute 126 for 152 or 154 (u-Man or u-Woman). Then, the player 126 can continue play as a u-man around the inverted triangle to a portal (stars on inner 116 pathway) as this allows access to level three and Dracula's Domain.

The transformation room 218 is where you transform to human shape if you have required items, possession cards, and Dracula-soulars. Thereafter on your next roll of the dice landing on a star space (Portal) and answering a Spookology Question allows you to move to the third level. On 3$^{rd}$ Level here again you must answer a spookology card question correctly to enter level. Upon entering the third level you then progress around outside playing area (using 1 die). Upon completion you can then enter the inner final space (Dracula's Domain). On this final space you defeat Dracula by correctly answering a Spookology question, if answered correct you win the game. If player incorrectly answers the question then that player returns to start of game as a Lesser Vampire and retires opponents by landing on the same space as opponent in subsequent play.

The Eight characters are: The Werewolf, Frankenstein, Skeleton, Mummy, Witch, Zombie, Ghost, and the Headless Horseman.

Common Rules; There are two methods of play Easy or Difficult. Players can choose method before start of game.

In the Easy Method (Method 1);

1. Players start with 3,000 souls. You Trick or Treat around the board each time you roll the dice. Players move around the board and collect or Trick or Treat at their opponent's residences (collecting 100 Dracula-soulars) at each location you land on if owned by an opponent OR bank if not.
2. Dracula owns the counting house (Bank) or you can devise your own monetary system with Halloween treats or items of your own choosing. You receive 2 Item cards on start of game; these can be sold to the bank for 500 souls or to another player for 600 souls.
3. You can place a Trespass token on the Graveyard, House of Horrors, and Room of Skulls by rolling 4 of the same numbers out of five dice.
4. To take possession and receive possessions card from an opponent or bank role the 5 dice. Rolling 4 of 5 of the same number obtains you a possession card.
5. You transform in transformation room 218 and must have a possession card, item cards, and 3000 Dracula-soulars to transform and allow a move to the third level (2 item cards to go to level 2; 3 item cards to go to 3$^{rd}$ level). Select a choice of rules from the difficult method rules for enhanced play.
6. If you have obtained a Trick or Treat card you can use it on any space to get out of trouble or use as a Wild card to complete items.

In the Difficult Method (Method 2):

1. Each player starts with 1000 dracula-soulars.
2. Use the sound effect of your playing character on the start, changing levels, transforming, and on finish or you miss a turn.
3. You can start on any of the 5 point star spaces on first level.
4. The person who rolls the highest number on the dice starts.
5. Play is ccw from start and when changing levels use two dice on the first level and one die on the second and third levels.
6. Two to eight players can play (the more the better the game); spaces are owned by bank if not playing.
7. You receive one hundred dracula-soulars for each Spookology question you answer correctly on (Portal) in addition to the amount on the Spookology card.
8. If you land on an opponent's space and that player is on that space or comes onto that space, the owner of that space can ask for one item card, or one hundred Dracula-soulars (if you don't have a trespass token on that space). Normal Fee or trespass toll is fifteen dracoola-soulars on the first level and thirty dracula-soulars on the second level.
9. You must travel the complete second level at least once ccw; be careful your opponents are watching; if they catch you doing something wrong they can take an item card.
10. After transforming in 218 on the second level before entering Dracula's domain you must also travel the second level inner section (Inverted Triangle of Pentagon) at least once as a U-man or U-woman. On your next roll of the dice, if you make it to a star space (portal) answering the Spookology Question correctly allows you to enter the third level.
11. The use of candy and other Halloween treats can be used in lieu of dracula-soulars in order to barter your way through the game in the first, second, and third levels and to pay the trespass toll in lieu of dracool-soulars.
12. Lucky/Unlucky; Superstition cards. If you pick up a unlucky card you may end up being sent to one of the rooms (House of Horrors, Room of Skulls, Bat Cave, or The Graveyard) or some other unlucky thing could happen to you. If you receive a Lucky card you may be given one of these items: Witches Broom, Enchanted ladder, Magic Rope, or Skeleton Key.
13. You enter higher levels of the game if you land on one of the five (5) point star (portal spaces) on the first level and answer a Spookology question correctly with required items. Place your player on corresponding portal on second level and answer another Spookology question to enter 2$^{nd}$ level. Repeat same sequence to enter 3$^{rd}$ level after Transforming in Transformation Room 218 with required items, possession card, and 3000 Dracula-soulars and answering Spookology correctly.

14. Spookology cards if answered correctly will allow you to move ahead a certain number of spaces; get out of the House of Horrors, Bat cave, Room of Skulls, or the Graveyard; send another player back a number of spaces or to one of the above rooms; get item cards you require to transform in the transformation room 218; and allow a move to 3$^{rd}$ level.

15. You can also obtain (use once then return to deck):

a. A Vial of blood—to receive a second life, returned when used.

b. Dagger—to cut off the zombie's head and send that character back a certain number of spaces, return when used.

c. Voodoo amulet—to ward off a zombie's attack and send that character back a certain number of spaces, return when used.

d. Magic rope, enchanted ladder, broom, Skelton key (if you have all three can go directly to transformation room 218).

e. Lantern—To find your way out of the graveyard, house of horrors, bat cave or spider's web, return when used.

f. Magic spells—to ward off an opponent and send that character back a certain number of spaces, return when used.

g. Invisibility spell—to move across anyone's property unseen.

h. Silver bullet—to ward off a werewolf's attack and send that character back a number of spaces, return when used.

i. Book of the living—to ward off the mummy and send that character back a number of spaces, return when used.

j. Bag of salt—to ward off the ghost and send that character back a certain number of spaces, return when used.

k. Cloak of skin—to ward off the skeleton and send that character back a certain number of spaces, return when used.

l. Lightening rod—to ward off the Frankenstein monster and send that character back a certain number of spaces.

m. Horseman's head—to ward off the headless horseman and send that character back a certain number of spaces return when used.

16. Dracula-soulars are used to purchase item cards and pay trespassing tolls.

17. You can't use the Trick or Treat card unless you own a player residence and have placed it on one of your spaces.

18. If you have acquired a combination of these three cards: key, ladder, broom, or magic rope you can go straight to the transformation room 218.

19. You can obtain a Possession Card by rolling five dice and obtaining three numbers of the same value then place a player residence on that space. When you have obtained a space with a player residence, you can collect an item card from a player that landed on your space in lieu of dracula-soulars; unless he has a trespass token on that space.

20. Each character has a distinctive player residence and trespass toll token:

a. Werewolf; has a doghouse residence and half-moon trespass token.

b. Zombie has a crypt residence and a brain trespass token.

c. Ghost; has a haunted house residence and ghost post trespass token.

d. Frankenstein monster; has a pub residence and hand trespass token.

e. Mummy; has a pyramid residence and coffin trespass token.

f. Witch; has a brewery residence and hat trespass token.

g. Headless horseman; has a haunted tree house and pumpkin trespass token.

h. Skeleton; has a headstone residence and skull trespass token.

21. To obtain a trespass token, when you are on a space roll the five dice, three of the same numbers allows you to place one of your (trespass tokens) on that space.

22. Roll the dice to get out of the (House of Horrors, Room of Skulls, Spiders Web, or The Graveyard). When you land on any of these spaces on your next turn you either roll any double on the five dice or pay Dracula one hundred dracoola-soulars. Unless you have a lucky/unlucky card that lets you trick or treat.

23. You must travel the complete star surface at least once along track #1, 2, 3, 4, 5, 1, 2, 3, 4, 5 . . . numerically from where you enter (#1 is, bottom to top, lower right hand corner of star playing surface).

24. A vampire can't retire you if you are in the transformation room 218.

25. On 3$^{rd}$ level there are four spaces owned by Dracula. You cannot own them but when you land on one of them you have to pay Dracula a certain number of dracula-soulars or give back one of your item cards. So collect as many item cards as possible or (buy them at the House of Souls or Graveyard).

26. Disregard instructions on the bottom of Spookology cards; you just answer the question correctly when transforming or challenging Dracula.

27. If you receive an invitation to attend a Halloween party on the third level, you cannot decline the invitation. If you don't have the item cards to continue play at this level, you become a lesser vampire or grim reaper and retired opponents from game.

28. upon entering the third level travel ccw around the outside of diamond. Once you have traversed once landing on a star space and (answering a spookology question correctly) enables you to enter the final space. On the final space you answer another spookology question correctly to win the game. If you answer incorrectly you become a lesser vampire; substitute your player for a Lesser Vampire piece; return to a start space to creating havoc for the other players.

It will be understood that each of the elements described above, or two or more together, may also find a useful application in other types of constructions differing from the types described above.

While the invention has been illustrated and described as embodiments of a 3D board game, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention as characters are generic to the overall Halloween theme.

It will be understood that each of the elements described above, or two or more together, may also find a useful application in other types of constructions differing from the types described above.

While the invention has been illustrated and described as embodiments of an electronic 3-D castle board game, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A Halloween Afternoon at Dracula's Castle board game which comprises:

a) a game board having a first outer pathway level, a second middle pathway level and a third inner pathway level, the first outer pathway level being in the form of a pentagon consisting of a plurality of contiguous delineated spaces, the second middle pathway level being in the form of a pentacle five pointed star consisting of a plurality of contiguous delineated spaces and the third inner pathway level being in the form of a diamond consisting of a plurality of contiguous delineated spaces and a Finish location;

b) a plurality of playing pieces for use by players, wherein the playing pieces are positionable on the spaces;

c) a plurality of player residences for use by the players;

d) a plurality of trespass tokens for use by the players;

e) chance determining means for indicating a number of spaces to be traversed by each the playing piece;

f) a plurality of play money of different denominations for distribution on start thereof to each player;

g) a plurality of spookology cards, each spookology card has a Halloween question and answer thereon, so that when one of the playing piece lands on a space indicating a pick of one spookology card the player of that playing piece will answer the Halloween question; and be rewarded as indicated within card instructions.

h) a plurality of lucky/unlucky cards, each lucky/unlucky card have a lucky/unlucky situations thereon, so that when one the playing piece lands on the space indicating a pick of one lucky/unlucky card, the player of the playing piece will follow the instructions; and be rewarded or harmed as per card instructions.

i) a plurality of item cards, wherein each of the item cards can be bought by each player with the play money or obtained through game cards;

j) a plurality of player sound pieces, each having a light and a silhouette to replicate a spooky player and Halloween sounds;

k) a bank tray to store remainder of the play money not distributed to the players, item cards, and possession cards therein, and l) A plurality of possession cards to show player ownership of individual locations.

2. The board game as recited in claim 1, wherein each of the playing piece comprises a figure of Dracula, female vampire, male vampire, U-Man, U-Woman, ghost, witch, Frankenstein monster, skeleton, mummy, headless horseman, werewolf and zombie.

3. The board game as recited in claim 2, wherein each of the player residence comprises a haunted house for the ghost, a brewery for the witch, a pub for the Frankenstein monster, ahead stone for the skeleton, a pyramid for the mummy, a haunted tree house for the headless horsemen, a doghouse for the werewolf and a crypt for the zombie.

4. The board game as recited in claim 2, wherein each of the trespass token comprises a ghost and signpost for the ghost, a hat for the witch, a hand for the Frankenstein monster, a skull for the skeleton, a coffin for the mummy, a pumpkin for the headless horseman, a half moon for the werewolf and a brain for the zombie.

5. The board game as recited in claim 1, wherein the chance determining means comprises five playing dice that are each pumpkin colored with bones as counters.

6. The board game as recited in claim 1, wherein the denominations of the play money consists of 1, 5, 10, 20, 50 and 100 dracoola-soulars.

7. The board game as recited in claim 1, wherein one of the lucky/unlucky cards comprises the words "TRICK OR TREAT" generic to Halloween theme.

8. The board game as recited in claim 1, wherein item cards contain one of the following: a holy cross, a heart, a holy bible, a ray of hope (sunshine), holy water, a garlic clove, a wooden stack, a vial of blood, a dagger, a voodoo amulet, a magic rope, an enchanted ladder, a broom, a skeleton key, a lantern, a list of magic spells, an invisibility spell, a silver bullet, a book of the living, a bag of salt, a cloak of skin, a lightening rod, and a horseman's head.

9. The board game as recited in claim 1, wherein the game board comprises:

a) a flat pentagon shaped base member having the first outer pathway level located about its perimeter, wherein each space at a corner of the base member has a five pointed star thereon; to be used as a portal to next level and a pick of a Spookology Card.

b) A three-dimensional plastic pentagon shaped castle having a roof with embedded pentacle shaped playing area, an outer wall, and five towers. The second middle pathway level located on the roof of the castle is a large star shaped pentacle with delineated spaces and five pointed star to indicate a pick of a Spookology card thereon, each tower located at one corner of the outer wall has a five pointed star space thereon to indicate a pick of a Spookology Card, wherein the castle (level three) is mounted onto the base member of level two, and c) A three-dimensional $3^{rd}$ level Dracula's Domain the inner level pathway is located on top of level two, wherein Dracula's domain is mounted centrally onto the roof in middle of the second middle pathway level. The playing area is an outer Diamond shaped pattern with an inner (Finish) space.

10. The board game as recited in claim 1, wherein the game board further comprises a Transformation Room on the $2^{nd}$ level.

11. The board game as recited in claim 1, wherein each player sound piece have a battery, a switch, light emitting diodes LEDs, a flashing/sound circuit and a speaker.

12. The board game as recited in claim 11, wherein the battery is selected from a group consisting of 1.5 Volts, 3 Volts, and 6 Volts.

13. The board game as recited in claim 11, wherein the flashing can be sequential, strobbing or chasing patterns in a timing sequence such as 1-15 flashes per second.

14. The board game as recited in claim 11, wherein the sound circuitry can have different Halloween theme sounds and songs.

15. The board game as recited in claim 9, wherein the three dimensional pentagon shape castle includes a switch, a battery, a flashing/sound circuit, each light emitting diodes LEDs installed in each tower of castle and a speaker for Halloween theme sounds and songs.

16. The board game as recited in claim 15, wherein the battery can be selected from a group consisting of 3 Volts, 6 Volts, 7.5 Volts, 9 Volts, 12 volts and 15 Volts.

17. The board game as recited in claim 15, wherein the flashing/sound circuitry can be a combined circuitry.

18. The board game as recited in claim 15, wherein the flashing/sound circuitry can be separated into a flashing circuitry and a sound circuitry.

19. The board game as recited in claim 15, wherein the flashing can be sequential, strobbing or chasing patterns in a timing sequence with different rate 1-15 flashes per second.

20. The board game as recited in claim 15, may incorporate as an accessory a CD/DVD disk with DVD player to provide a Halloween atmosphere with theme sounds and songs.

* * * * *